US010648660B2

(12) United States Patent
Chen

(10) Patent No.: US 10,648,660 B2
(45) Date of Patent: May 12, 2020

(54) EASY-TO-USE COMBUSTION DEVICE

(71) Applicant: Pro-Iroda Industries, Inc., Taichung (TW)

(72) Inventor: Wei-Long Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 173 days.

(21) Appl. No.: 15/939,516

(22) Filed: Mar. 29, 2018

(65) Prior Publication Data

US 2019/0301730 A1 Oct. 3, 2019

(51) Int. Cl.

| | |
|---|---|
| ***F23C 7/00*** | (2006.01) |
| ***F23D 3/20*** | (2006.01) |
| ***F23D 3/04*** | (2006.01) |

(52) U.S. Cl.

CPC ..... *F23C 7/008* (2013.01); *F23C 7/004* (2013.01); *F23D 3/04* (2013.01); *F23D 3/20* (2013.01)

(58) Field of Classification Search

CPC .... F23D 3/00; F23D 3/02; A24F 15/10; F23C 7/008

USPC ..... 431/319, 353

See application file for complete search history.

(56) References Cited

U.S. PATENT DOCUMENTS

| | | | | |
|---|---|---|---|---|
| 80,590 | A * | 8/1868 | Brockington | A24F 15/10 431/319 |
| 444,278 | A | 1/1891 | McDaniel | |
| 4,793,321 | A | 12/1988 | Rafford et al. | |
| 9,267,681 | B2 | 2/2016 | Barudi et al. | |
| 9,377,187 | B2 | 6/2016 | Chen | |
| 9,557,051 | B2 | 1/2017 | Chen | |
| 2013/0252188 | A1 | 9/2013 | Chen | |
| 2013/0323659 | A1* | 12/2013 | White | F23D 3/18 431/321 |
| 2015/0167964 | A1 | 6/2015 | Chen | |
| 2017/0176017 | A1 | 6/2017 | Husted et al. | |

FOREIGN PATENT DOCUMENTS

| | | | |
|---|---|---|---|
| GB | 442496 | A | 2/1936 |
| JP | 395069 | | 2/1939 |
| JP | 2002372232 | A | 12/2002 |
| SU | 1455131 | A1 | 1/1989 |
| TW | M431289 | U | 6/2012 |

* cited by examiner

*Primary Examiner* — Grant Moubry
*Assistant Examiner* — Aaron H Heyamoto
(74) *Attorney, Agent, or Firm* — Alan D. Kamrath; Karin L. Williams; Mayer & Williams PC

(57) ABSTRACT

The present invention provides a combustion device, which includes a fuel tank assembly and a candle wick. The fuel tank assembly includes a first tank, a second tank, a connection tube, and a switch. The capacity of the second tank is less than the capacity of the first tank. An end of the connection tube is connected to the first tank, and another end of the connection tube is connected to the second tank. The connection tube communicates with internal spaces of the first and second tanks. The switch is disposed between the first and second tanks so as to selectively open or close a channel interconnected between the first and second tanks. The candle wick is mounted in the second tank. Therefore, the combustion device is easy to use by the above structure.

8 Claims, 9 Drawing Sheets

EASY-TO-USE COMBUSTION DEVICE

BACKGROUND OF THE INVENTION

The present invention relates to a combustion device and, in particular, to a combustion device that is easy to use.

U.S. Pat. No. 9,377,187 discloses a combustion device provided with a control head. The control head delimits an opening and has a flow guiding mechanism, which includes a plurality of vanes and a control mechanism delimiting a hole. The plurality of vanes is disposed along a circumference of the opening one after another. Every two adjacent vanes form a spiral air passage therebetween. The hole has a diametrical size which varies with respect to different sizes of flames of the combustion device. The hole corresponds to and is in communication with the opening. The hole has a smaller diametrical size than the opening. A hollow and transparent shield is disposed above the control head and adjacent to the control mechanism. The shield delimits a space in communication with the hole of the control mechanism.

When the flame generated by the above combustion device is to be extinguished after use, contact between the air's oxygen and the candle wick must be eliminated. If the user only blocks the opening on the shield, air will still flow through the flow guiding mechanism to contact the candle wick hidden in the combustion device and prevent the flame from being extinguished. Therefore, the user must remove the shield or move the candle wick by a long rod and then put a containment lid on the candle wick to avoid contact between the air's oxygen and the candle wick. However, when the flame is large, it is not easy to put the containment lid on the candle wick and there is a risk of scalding. Additionally, the tip end of the candle wick still maintains a very high temperature for a period of time after extinguishing the flame by the above manner, and the fuel continues to be conveyed to touch the tip of the candle wick to cause the candle wick to be carbonized to create smoke and odor.

Thus, a need exists for a novel combustion device with easily recognizable size indicia to mitigate and/or obviate the above disadvantages.

SUMMARY OF THE INVENTION

A combustion device according to the present invention includes a fuel tank assembly and a candle wick. The fuel tank assembly includes a first tank, a second tank, a connection tube, and a switch. A capacity of the second tank is less than a capacity of the first tank. An end of the connection tube is connected to the first tank, and another end of the connection tube is connected to the second tank, such that the connection tube communicates with internal spaces of the first and second tanks. The switch is disposed between the first and second tanks to selectively open or close a channel interconnected between the first and second tanks. The candle wick is mounted in the second tank.

In an example, the first tank has an opening. The fuel tank assembly further includes a blocking member and a filling seat. The blocking member is mounted on the opening and has a first connecting hole extended therethrough. The filling seat is pivotally connected to the blocking member to be pivotable in relation to the blocking member between a sealing position and a filling position. The filling seat has a second connecting hole adjacent to the blocking member and selectively aligned to the first connecting hole of the blocking member. When the filling seat is in the sealing position, the second connecting hole is not aligned to the first connecting hole. When the filling seat is in the filling position, the second connecting hole is aligned to the first connecting hole.

In an example, the switch is disposed between two opposite ends of the connection tube.

In an example, the combustion device further includes a flow guiding assembly including a support, a plurality of guide vanes, a first shield member, and a second shield member. The support has an insertion hole. The plurality of guide vanes is secured in an inner periphery of the insertion hole. The first shield member is fixed at a side of the support and has a first end and a second end opposite to the first end. The second shield member is disposed at the side of the support adjacent to the first shield member and has a first end and a second end opposite to the first end. The first end of the second shield member is pivotally connected to the first end of the first shield member. The second shield member is pivotable in relation to the first shield member between a closed position and an open position. When the second shield member is in the closed position, the second end of the second shield member is attached to the second end of the first shield member. When the second shield member is in the open position, the second end of the second shield member is detached from the second end of the first shield member to form a gap. The plurality of guide vanes is disposed between the first and second shield members. The candle wick is disposed between the plurality of guide vanes.

In an example, the candle wick has a bottom end and a top end opposite to the bottom end. The bottom end is inserted into the second tank. The top end is exposed out of the second tank. The top end is higher than bottom edges of the first and second shield members in a plumb direction.

In an example, the flow guiding assembly further includes a connector mounted around the second tank. A bottom edge of the plurality of guide vanes is fixed to the connector. The first and second shield members are disposed on a side of the support opposite to the connector.

In an example, the combustion device further includes a housing including a base plate, a roof plate, and a partition plate disposed between the base plate and the roof plate. A side of the partition plate adjacent to the base plate forms an internal space, and another side of the partition plate adjacent to the roof plate forms a viewing space. The partition plate further has a through-hole communicating with the internal and viewing spaces. The fuel tank assembly is disposed in the internal space. A side of the first shield member opposite to the support is fixed to the partition plate. The first and second shield members are aligned to the through-hole.

In an example, the housing further includes a rear plate and a front plate. An end of the rear plate is connected to a side of the base plate, and another end of the rear plate is connected to a side of the roof plate. A face of the rear plate is connected to a rear edge of the partition plate. The front plate is pivotally connected to a side of the base plate opposite to the rear plate. A side of the front plate opposite to the base plate is pivotable to be close to or away from the partition plate. The filling seat further has a filling portion disposed opposite to the blocking member. When the filling seat is in the sealing position, the filling portion is not faced to the front plate. When the filling seat is in the filling position, the filling portion is faced to the front plate.

In an example, the housing further includes two side plates connected to the base plate, the rear plate, and two side edges of the partition plate.

In an example, the housing further includes three first transparent members and a second transparent member. Each of the three first transparent members is formed as a transparent plate and is mounted between the roof plate and the partition plate. The second transparent member is formed as a transparent tube and is mounted between the roof plate and the through-hole of the partition plate.

DETAILED DESCRIPTION OF THE INVENTION

Figure 1:
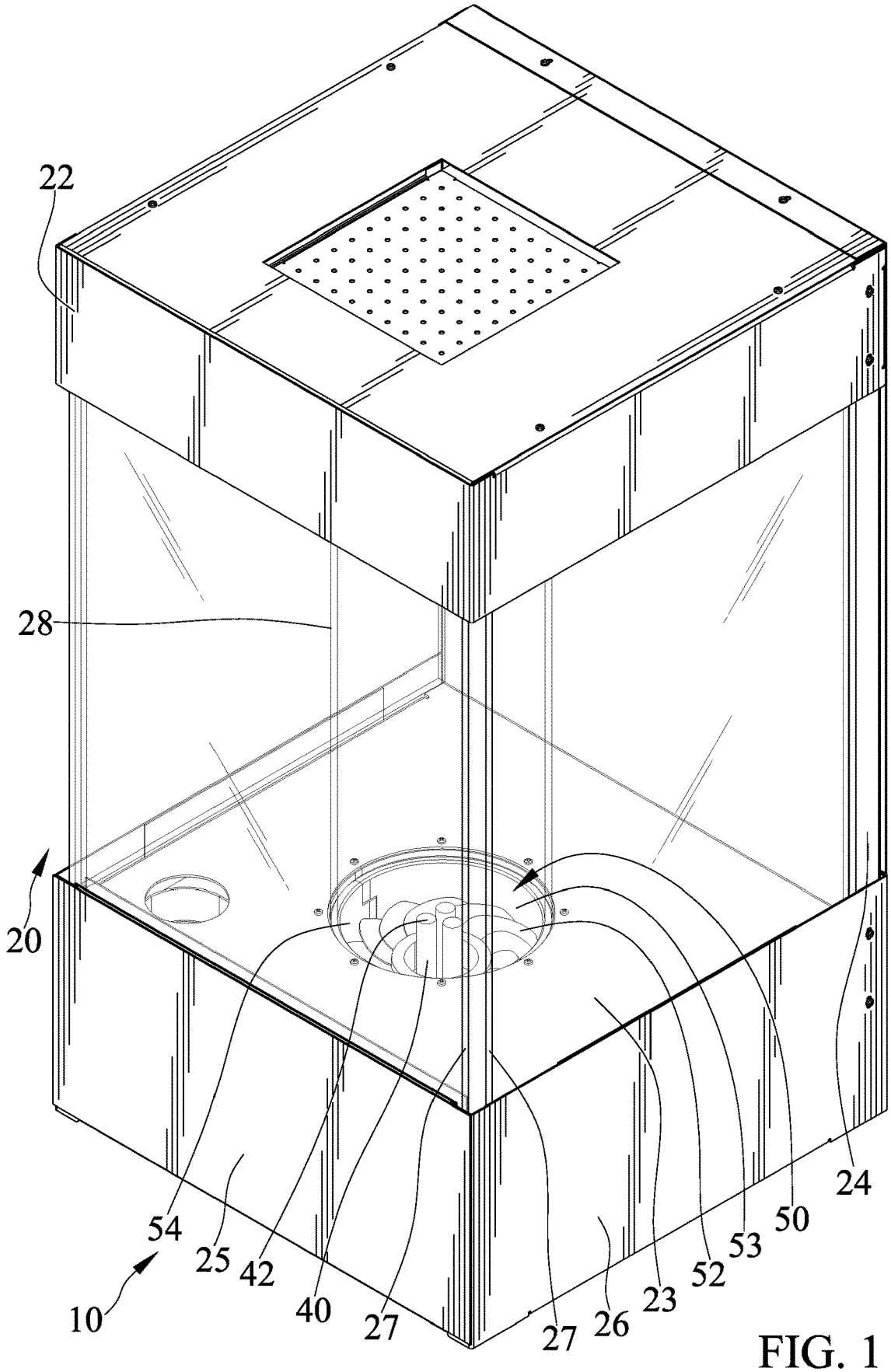
FIG. 1 is a perspective view of a combustion device according to the present invention.
Figure 2:
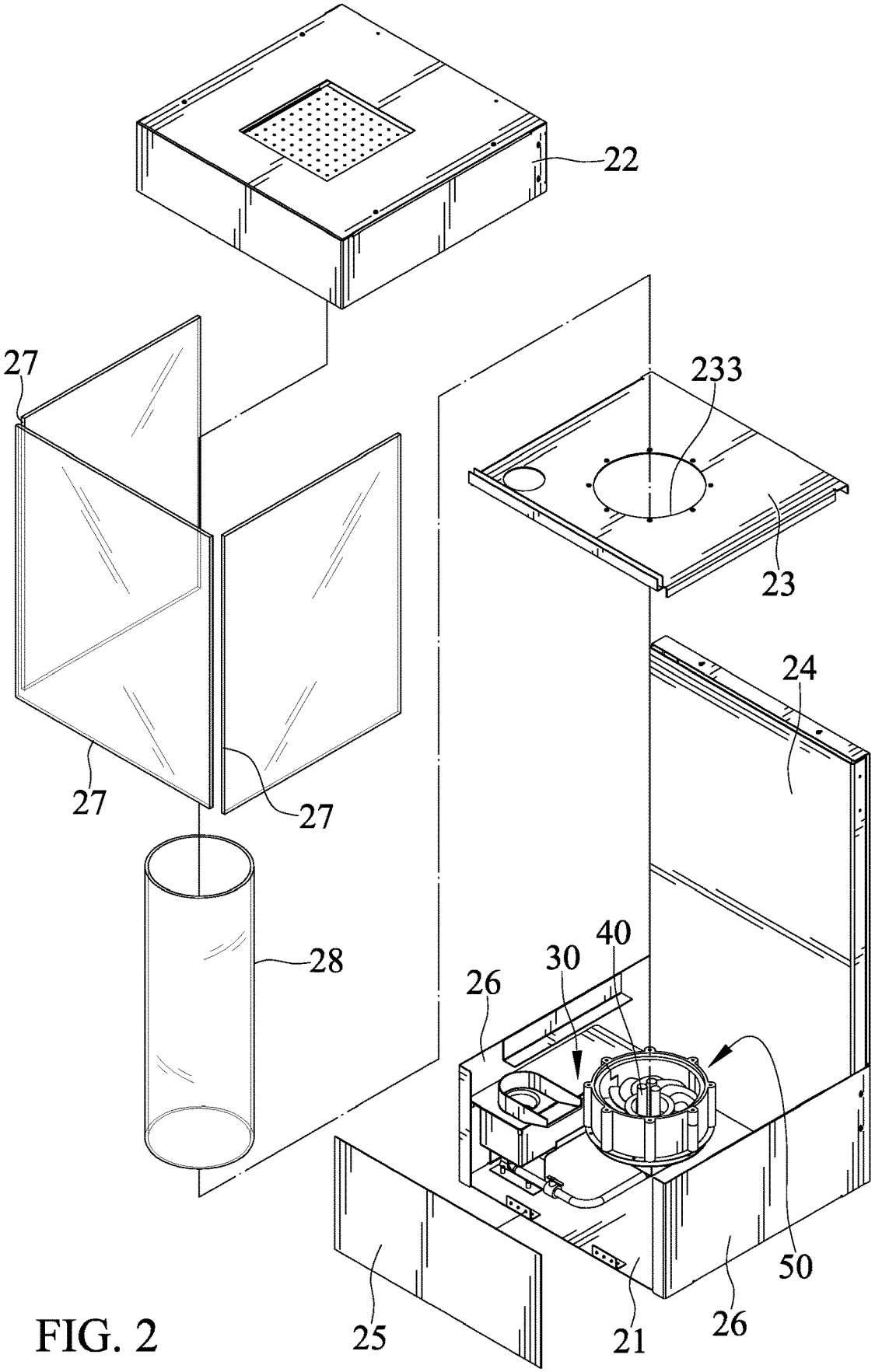
FIGS. 2 and 3 are exploded, perspective views of the combustion device of FIG. 1.
Figure 3:
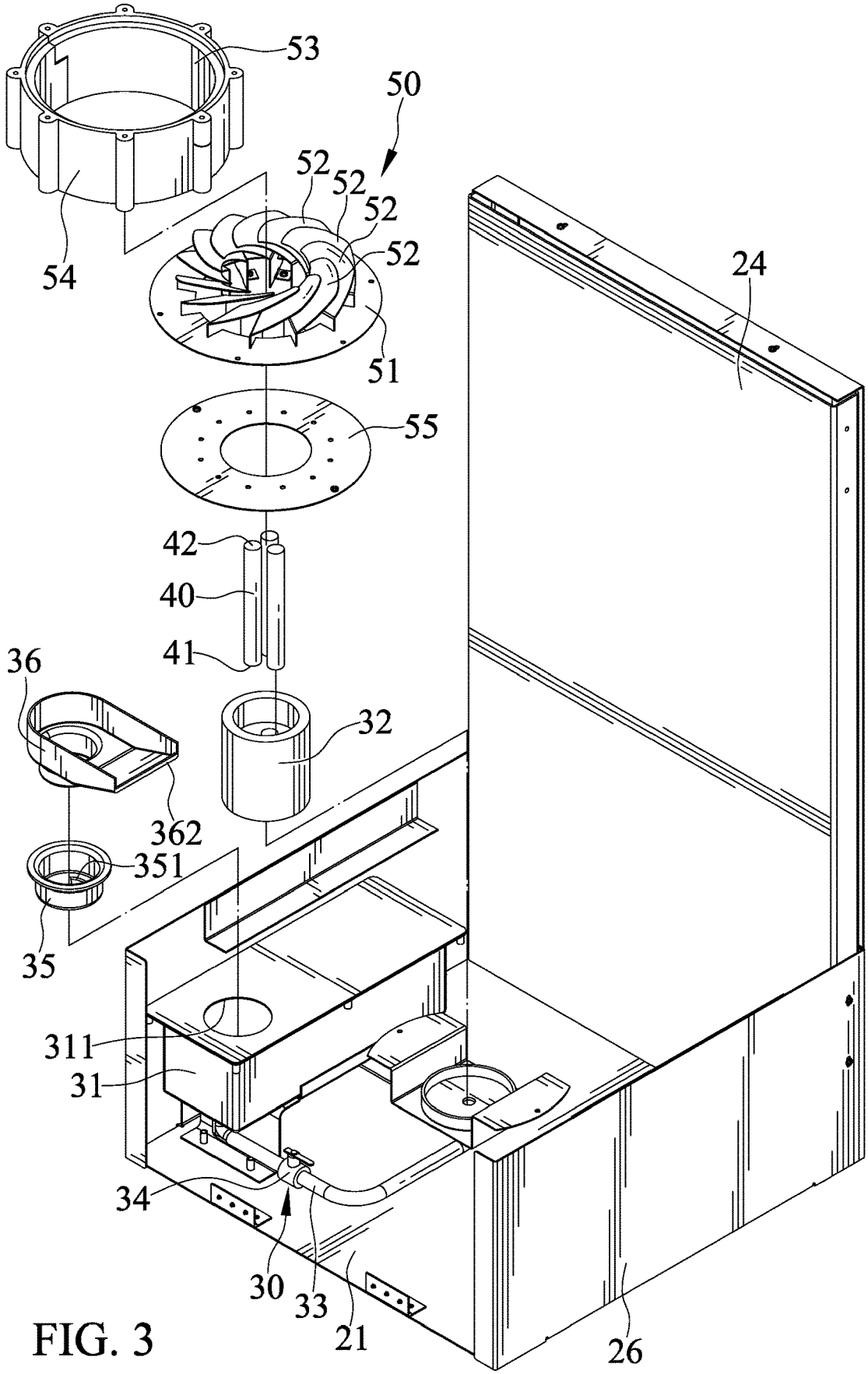
Figure 4:
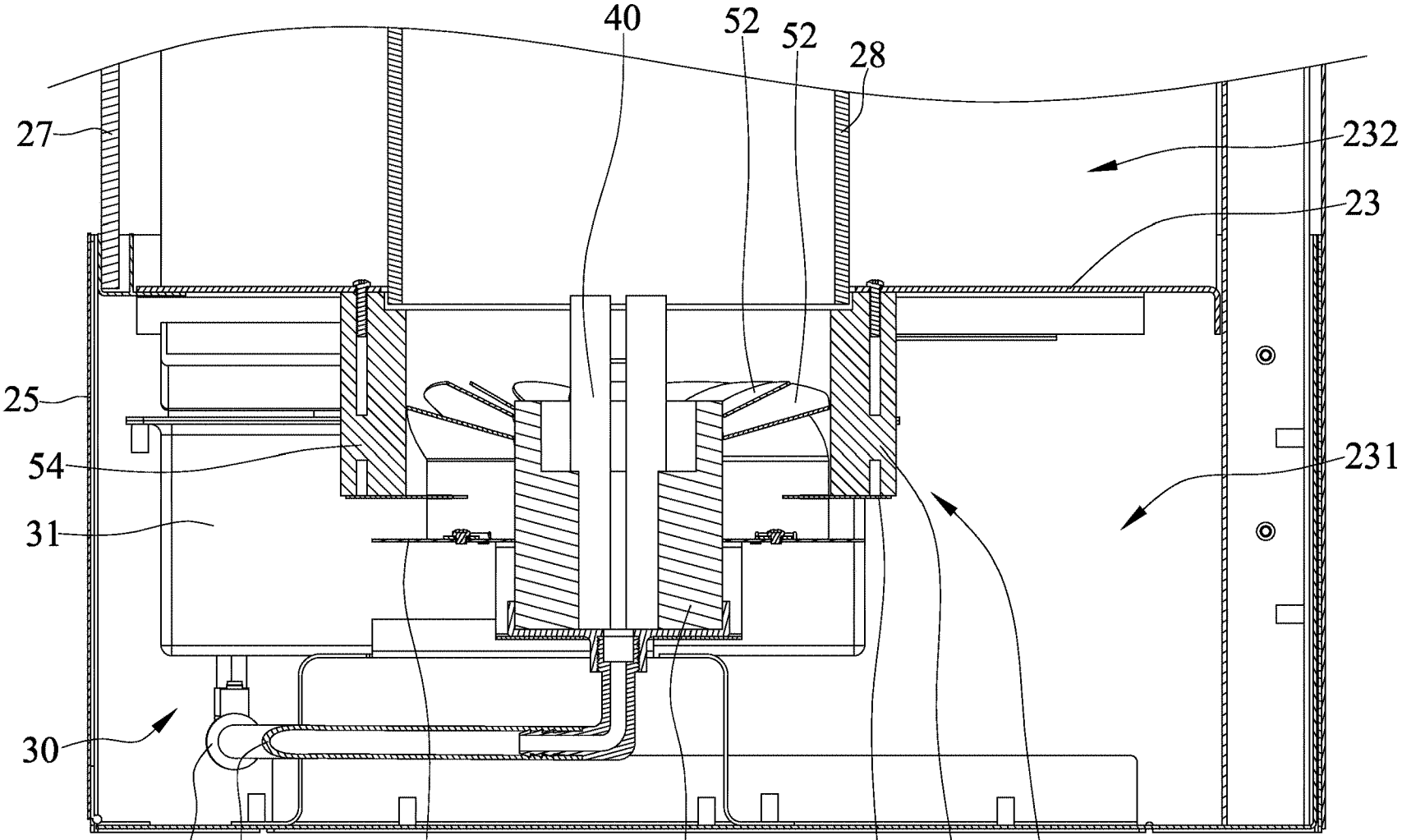
FIGS. 4 and 5 are partial cross-sectional views of the combustion device of FIG. 1.
Figure 5:
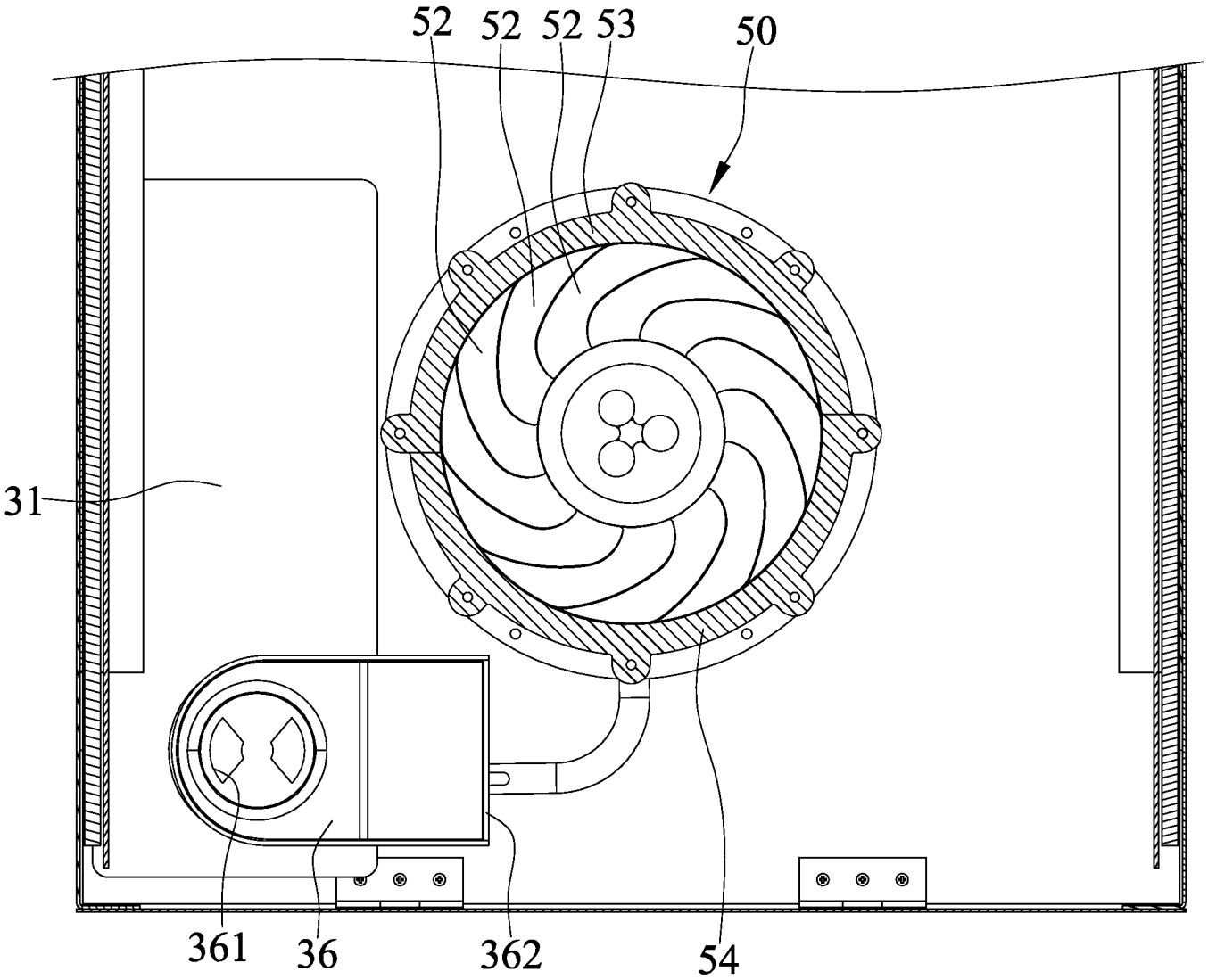
Figure 6:
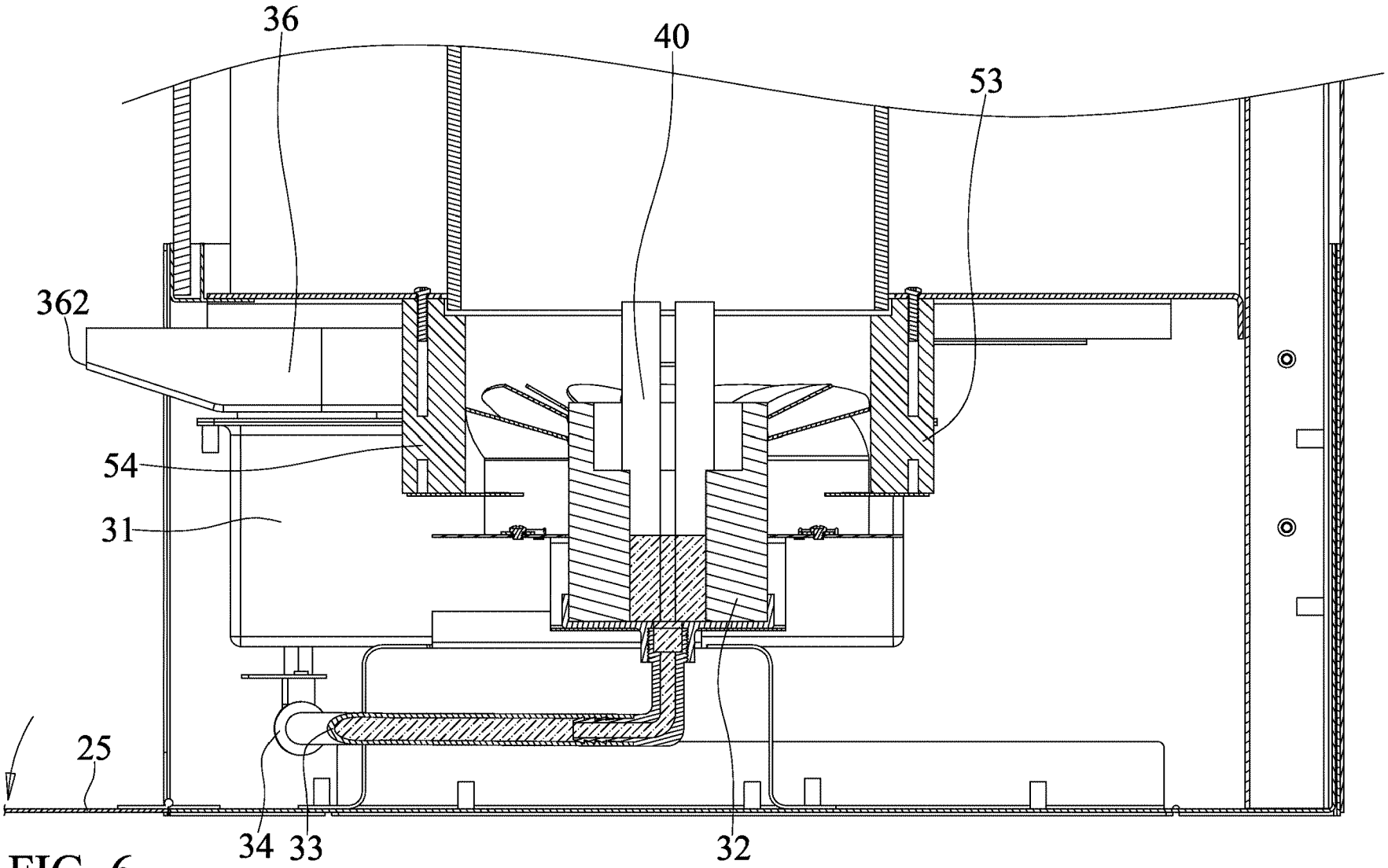
FIGS. 6-9 are state diagrams illustrating operation of the combustion device of FIG. 1.
Figure 7:
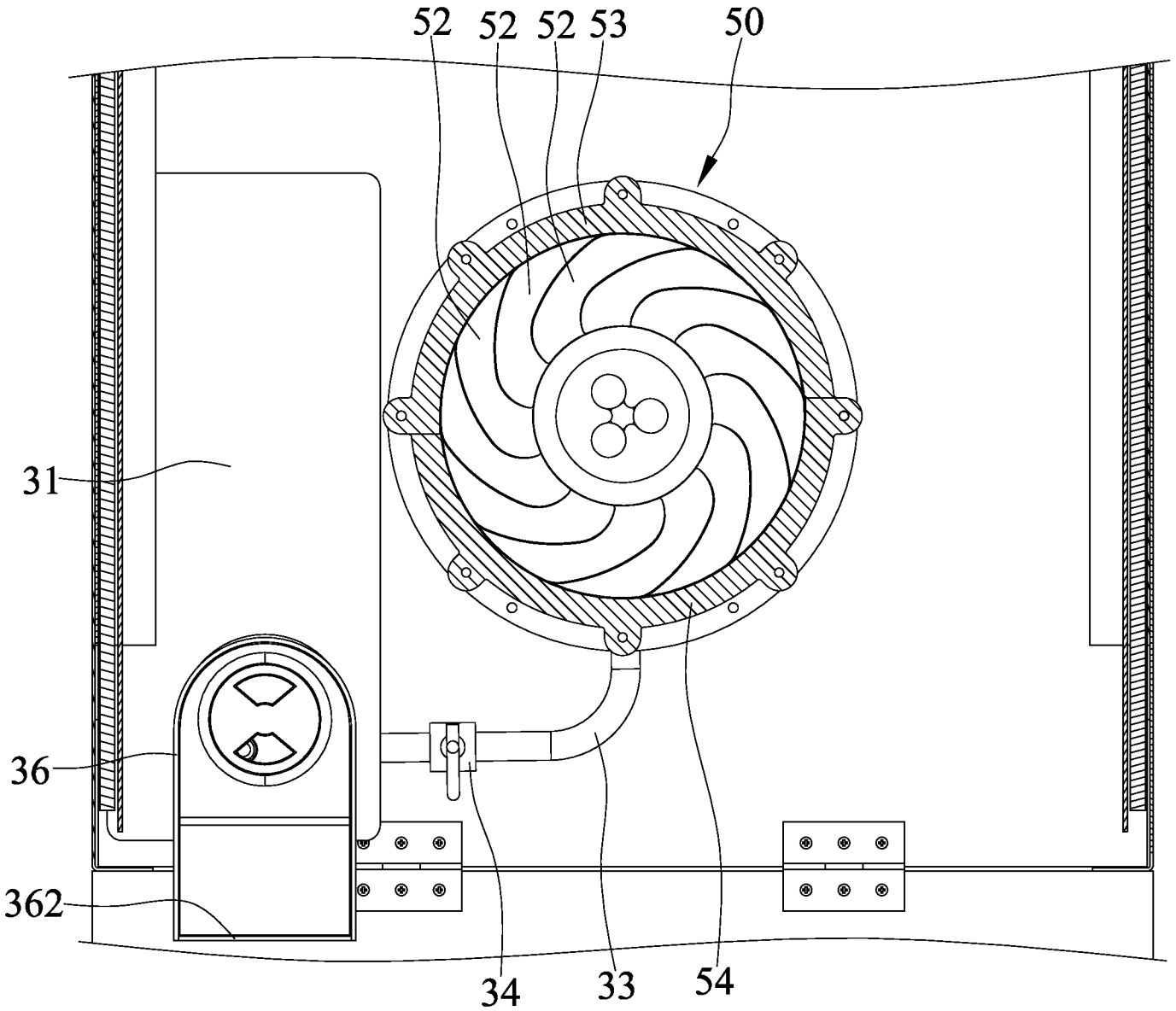
Figure 8:
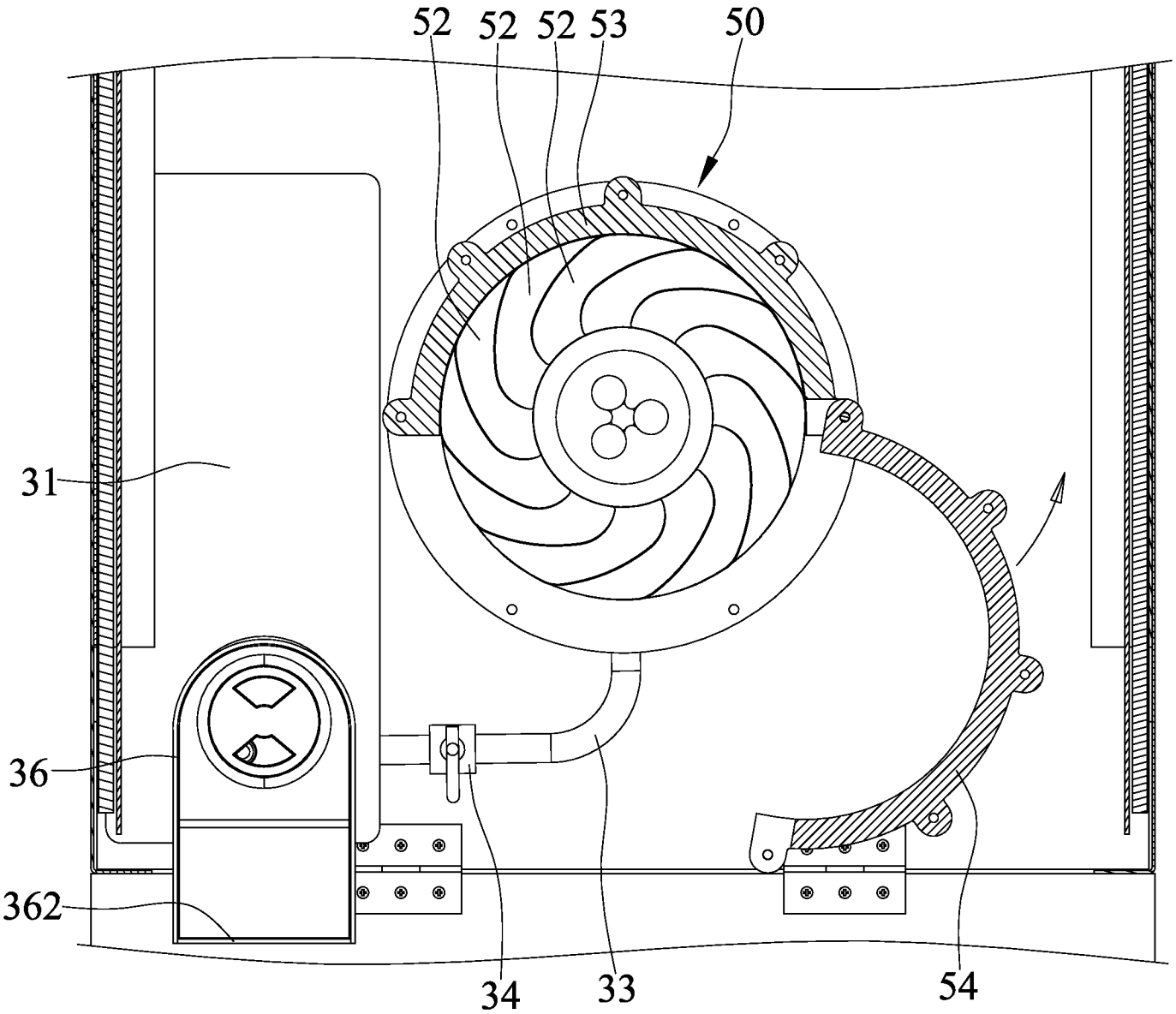
Figure 9:
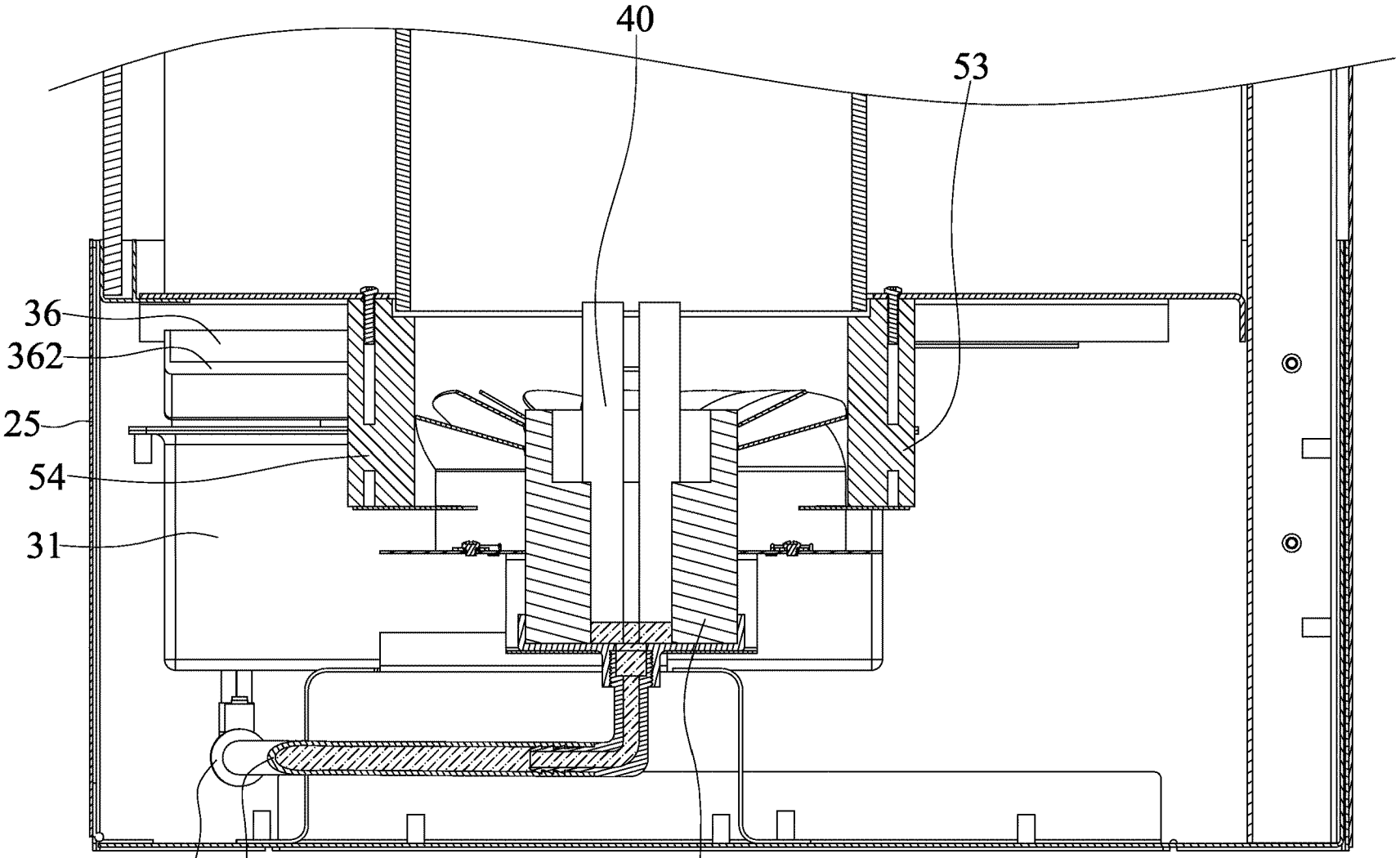

FIGS. 1-9 show a combustion device 10 according to the present invention. Combustion device 10 includes a housing 20, a fuel tank assembly 30, a candle wick 40, and a flow guiding assembly 50.

Housing 20 includes a base plate 21, a roof plate 22, a partition plate 23 disposed between base plate 21 and roof plate 22, a rear plate 24, a front plate 25, and two side plates 26. A side of partition plate 23 adjacent to base plate 21 forms an internal space 231, and another side of partition plate 23 adjacent to roof plate 22 forms a viewing space 232. Partition plate 23 further has a through-hole 233 communicating with internal and viewing spaces 231 and 232.

An end of rear plate 24 is connected to a side of base plate 21, and another end of rear plate 24 is connected to a side of roof plate 22. A face of rear plate 24 is connected to a rear edge of partition plate 23.

Front plate 25 is pivotally connected to a side of base plate 21 opposite to rear plate 24 so as a side of front plate 25 opposite to base plate 21 is pivotable to be close to or away from partition plate 23. Two side plates 26 are connected to base plate 21, rear plate 24, and two side edges of partition plate 23.

Housing 20 further includes three first transparent members 27 and a second transparent member 28. Each of three first transparent members 27 is formed as a transparent plate and is mounted between roof plate 22 and partition plate 23. Second transparent member 28 is formed as a transparent tube and is mounted between roof plate 22 and through-hole 233 of partition plate 23.

Fuel tank assembly 30 is disposed in internal space 231 and includes a first tank 31, a second tank 32, a connection tube 33, and a switch 34. A capacity of second tank 32 is less than that of first tank 31. An end of connection tube 33 is connected to first tank 31, and another end of connection tube 33 is connected to second tank 32 so as connection tube 33 communicates with internal spaces of first and second tanks 31 and 32. Switch 34 is disposed between first and second tanks 31 and 32 to selectively open or close a channel interconnected between first and second tanks 31 and 32. In the embodiment, switch 34 may be disposed between two opposite ends of connection tube 33.

First tank 31 has an opening 311. Fuel tank assembly 30 further includes a blocking member 35 and a filling seat 36. Blocking member 35 is mounted on opening 311 and has a first connecting hole 351 extended therethrough. Filling seat 36 is pivotally connected to blocking member 35 to be pivotable in relation to blocking member 35 between a sealing position and a filling position. Filling seat 36 has a second connecting hole 361 adjacent to blocking member 35 and selectively aligned to first connecting hole 351 of blocking member 35, and a filling portion 362 disposed opposite to blocking member 35 and selectively faced to front plate 25. When filling seat 36 is in the sealing position, second connecting hole 361 is not aligned to first connecting hole 351, and filling portion 362 is not faced to front plate 25. When the filling seat 36 is in the filling position, second connecting hole 361 is aligned to first connecting hole 351, and filling portion 362 is faced to front plate 25.

Candle wick 40 has a bottom end 41 and a top end 42 opposite to bottom end 41. Bottom end 41 is inserted into second tank 32, and top end 42 is exposed out of second tank 32.

Flow guiding assembly 50 includes a support 51, a plurality of guide vanes 52, a first shield member 53, and a second shield member 54. Support 51 has an insertion hole, and plurality of guide vanes 52 is secured in an inner periphery of the insertion hole. First shield member 53 is fixed at a side of support 51 and has a first end 531 and a second end 532 opposite to first end 531. Second shield member 54 is disposed at the side of support 51 adjacent to first shield member 53 and has a first end 541 and a second end 542 opposite to first end 541. First end 541 of second shield member 54 is pivotally connected to first end 531 of first shield member 53, so as second shield member 54 is pivotable in relation to first shield member 53 between a closed position and an open position. When second shield member 54 is in the closed position, second end 542 of second shield member 54 is attached to second end 532 of first shield member 53. When second shield member 54 is in the open position, second end 542 of second shield member 54 is detached from second end 532 of first shield member 53 to form a gap. Plurality of guide vanes 52 is disposed between first and second shield members 53 and 54. Candle wick 40 is disposed between plurality of guide vanes 52. Top end 42 is higher than bottom edges of first and second shield members 53 and 54 in a plumb direction.

Flow guiding assembly 50 further includes a connector 55 mounted around second tank 32. A bottom edge of plurality of guide vanes 52 is fixed to connector 55. First and second shield members 53 and 54 are disposed on a side of support 51 opposite to connector 55. A side of first shield member 53 opposite to support 51 is fixed to partition plate 23, and first and second shield members 53 and 54 are aligned to through-hole 233 of partition plate 23.

Combustion device 10 is easy to use by the above structure. Filling seat 36 can be rotated to the filling position, after opening front plate 25. The fuel can be poured from filling portion 362 to flow into first tank 31, and then the fuel flows into second tank 32 via connection tube 33. Candle wick 40 in second tank 32 conveys the fuel, and second shield member 54 can be moved to the open position, so as an igniter can light candle wick 40 via the gap between first and second shield members 53 and 54. Returning second shield member 54, filling seat 36, and front plate 25 to the initial position, combustion device 10 can continue to operate to generate flame. If the user intends to extinguish the flame, the user only needs to open front plate 25 and turn off switch 34. After turning off switch 34, the flame on candle wick 40 only can be burning for a short time due to the smaller capacity of second tank 32. The flame will naturally be extinguished when the fuel in second tank 32 is extinguished. Thus, it can greatly reduce the smoke and smell because the flame is extinguished in the absence of the fuel.

Additionally, support 51, plurality of guide vanes 52, first shield member 53 and second shield member 54 of flow guiding assembly 50 can be made of sheet metal working or stretching working to effectively simplify the structure of flow guiding assembly 50 and to reduce the production cost.

Furthermore, housing 20 can cover all elements of the fuel tank assembly 30, candle wick 40 and flow guiding assembly 50 to cause housing 20 to have an exquisite appearance. The heat is not easily transmitted to the outermost side of housing 20 to effectively prevent the user or children from being inadvertently scalded.

While various embodiments have been described above, it should be understood that they have been presented by way of example only, and not limitation. For example, any of the elements may employ any of the desired functionality set forth hereinabove. Thus, the breadth and scope of a preferred embodiment should not be limited by any of the above-described exemplary embodiments.

What is claimed is:

1. A combustion device comprising:

a fuel tank assembly including a first tank, a second tank, a connection tube, and a switch, wherein a capacity of the second tank is less than a capacity of the first tank, wherein an end of the connection tube is connected to the first tank, and another end of the connection tube is connected to the second tank, wherein the connection tube communicates with internal spaces of the first and second tanks, wherein the switch is disposed between the first and second tanks to selectively open or close the connection tube interconnected between the first and second tanks;

a candle wick mounted in the second tank, wherein the first tank has an opening, wherein the fuel tank assembly further includes a blocking member and a filling seat, wherein the blocking member is mounted on the opening and has a first connecting hole extended therethrough, wherein the filling seat is pivotally connected to the blocking member to be pivotable in relation to the blocking member between a sealing position and a filling position, and wherein the filling seat has a second connecting hole adjacent to the blocking member and selectively aligned to the first connecting hole of the blocking member, wherein when the filling seat is in the sealing position, the second connecting hole is not aligned to the first connecting hole, wherein when the filling seat is in the filling position, the second connecting hole is aligned to the first connecting hole, and a flow guiding assembly including a support, a plurality of guide vanes, a first shield member, and a second shield member, wherein the support has an insertion hole, wherein the plurality of guide vanes is secured in an inner periphery of the insertion hole, wherein the first shield member is fixed at a side of the support and has a first end and a second end opposite to the first end, wherein the second shield member is disposed at the side of the support adjacent to the first shield member and has a first end and a second end opposite to the first end, wherein the first end of the second shield member is pivotally connected to the first end of the first shield member, wherein the second shield member is pivotable in relation to the first shield member between a closed position and an open position, wherein when the second shield member is in the closed position, the second end of the second shield member is attached to the second end of the first shield member, wherein when the second shield member is in the open position, the second end of the second shield member is detached from the second end of the first shield member to form a gap, wherein the plurality of guide vanes is disposed between the first and second shield members, and wherein the candle wick is disposed between the plurality of guide vanes.

2. The combustion device as claimed in claim 1, wherein the switch is disposed between two opposite ends of the connection tube.

3. The combustion device as claimed in claim 1, wherein the candle wick has a bottom end and a top end opposite to the bottom end, wherein the bottom end is inserted into the second tank, wherein the top end is exposed out of the second tank, and wherein the top end is higher than bottom edges of the first and second shield members in a plumb direction.

4. The combustion device as claimed in claim 1, wherein the flow guiding assembly further includes a connector mounted around the second tank, wherein a bottom edge of the plurality of guide vanes is fixed to the connector, and wherein the first and second shield members are disposed on a side of the support opposite to the connector.

5. The combustion device as claimed in claim 1, further comprising:

a housing including a base plate, a roof plate, and a partition plate disposed between the base plate and the roof plate, wherein a side of the partition plate adjacent to the base plate forms an internal space, and another side of the partition plate adjacent to the roof plate forms a viewing space, wherein the partition plate further has a through-hole communicating with the internal and viewing spaces, wherein the fuel tank assembly is disposed in the internal space, wherein a side of the first shield member opposite to the support is fixed to the partition plate, and wherein the first and second shield members are aligned to the through-hole.

6. The combustion device as claimed in claim 5, wherein the housing further includes a rear plate and a front plate, wherein an end of the rear plate is connected to a side of the base plate, and another end of the rear plate is connected to a side of the roof plate, wherein a face of the rear plate is connected to a rear edge of the partition plate, wherein the front plate is pivotally connected to a side of the base plate opposite to the rear plate, wherein a side of the front plate opposite to the base plate is pivotable to be close to or away from the partition plate, and wherein the filling seat further has a filling portion disposed opposite to the blocking member, wherein when the filling seat is in the sealing position, the filling portion is not faced to the front plate, wherein when the filling seat is in the filling position, the filling portion is faced to the front plate.

7. The combustion device as claimed in claim 6, wherein the housing further includes two side plates connected to the base plate, the rear plate, and two side edges of the partition plate.

8. The combustion device as claimed in claim 7, wherein the housing further includes three first transparent members and a second transparent member, wherein each of the three first transparent members is formed as a transparent plate and is mounted between the roof plate and the partition plate, and wherein the second transparent member is formed as a transparent tube and is mounted between the roof plate and the through-hole of the partition plate.

* * * * *